US011092121B2

(12) United States Patent
Miki et al.

(10) Patent No.: US 11,092,121 B2
(45) Date of Patent: Aug. 17, 2021

(54) SADDLE RIDING VEHICLE

(71) Applicant: HONDA MOTOR CO., LTD., Tokyo (JP)

(72) Inventors: Sosuke Miki, Asaka (JP); Mikihiko Kawase, Asaka (JP); Akiyuki Karashima, Asaka (JP); Jun Hariu, Asaka (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/665,202

(22) Filed: Oct. 28, 2019

(65) Prior Publication Data

US 2020/0158054 A1 May 21, 2020

(30) Foreign Application Priority Data

Nov. 16, 2018 (JP) ..... JP2018-216000

(51) Int. Cl.
*F02M 35/10* (2006.01)
*F02M 35/16* (2006.01)
*F01P 1/06* (2006.01)

(52) U.S. Cl.
CPC ..... *F02M 35/10013* (2013.01); *F01P 1/06* (2013.01); *F02M 35/10242* (2013.01); *F02M 35/162* (2013.01); *F01P 2050/16* (2013.01)

(58) Field of Classification Search
CPC ..... B62K 19/48; B62K 11/00; F02M 35/162; F02M 35/048
See application file for complete search history.

(56) References Cited

U.S. PATENT DOCUMENTS 5,426,571 A * 6/1995 Jones ..... B60Q 1/115 362/286
2006/0219201 A1* 10/2006 Seki ..... F02M 35/162 123/184.55
2007/0069545 A1 3/2007 Katagiri et al.
2008/0169134 A1* 7/2008 Tomolillo ..... B62K 25/283 180/6.24
2010/0071991 A1* 3/2010 Ono ..... F02M 35/10354 181/229
2014/0116794 A1* 5/2014 Kawai ..... B62K 11/04 180/68.1
2015/0015019 A1* 1/2015 Matsuoka ..... B62J 17/02 296/84.1
2015/0107563 A1* 4/2015 Naruoka ..... B62K 11/04 123/559.1

(Continued)

FOREIGN PATENT DOCUMENTS

JP 3723792 12/2005
JP 2012-051443 3/2012

OTHER PUBLICATIONS

Indian Office Action dated Jan. 28, 2021, English translation included, 6 pages.

*Primary Examiner* — Long T Tran
(74) *Attorney, Agent, or Firm* — Rankin, Hill & Clark LLP

(57) ABSTRACT

An intake duct has a front-rear two-split structure, and includes a rear duct connected to a body frame and a front duct connected to the rear duct. The rear duct includes a body frame connection portion that is connected to the body frame and is attached with a rear stay that supports a cowl and a meter, and the front duct is directed forward from the rear duct.

5 Claims, 9 Drawing Sheets

(56) References Cited

U.S. PATENT DOCUMENTS

| | | | | |
|---|---|---|---|---|
| 2016/0215691 | A1* | 7/2016 | Watanabe | F02D 35/027 |
| 2017/0015382 | A1* | 1/2017 | Takakuwa | B62J 6/027 |
| 2017/0057594 | A1* | 3/2017 | Watanabe | B62L 1/00 |
| 2017/0327026 | A1* | 11/2017 | Suzuki | B62J 17/02 |
| 2018/0119654 | A1* | 5/2018 | Naruoka | B62J 17/00 |
| 2018/0274502 | A1* | 9/2018 | Tani | F02M 35/10098 |

* cited by examiner

SADDLE RIDING VEHICLE

INCORPORATION BY REFERENCE

The present application claims priority under 35 U.S.C. § 119 to Japanese Patent Application No. 2018-216000 filed on Nov. 16, 2018. The content of the application is incorporated herein by reference in its entirety.

TECHNICAL FIELD

The present invention relates to a saddle riding vehicle.

BACKGROUND ART

Conventionally, as a saddle riding vehicle, there is known one in which a center duct is supported by a body frame and is arranged so as to be stretched in the vehicle longitudinal direction within a cowl, a stay is arranged in the center duct, and thereby the cowl and the like are supported (refer to Patent Literature 1 for example).

An opening is arranged in the cowl, and an opening at the distal end portion of the duct is connected to the opening of the cowl.

CITATION LIST

Patent Literature

[Patent Literature 1] Japanese Patent No. 3723792

SUMMARY OF INVENTION

Technical Problem

According to Patent Literature 1, when the body forming component such as the cowl disposed around the center duct is to be supported by the center duct, since the center duct is long in the vehicle longitudinal direction, if the rigidity of the center duct is increased, the weight increases by that portion. Also, in the case of coping with a plural number of the cowl shapes or in the case of arranging a flexible duct shape within the cowl, it is desired to increase the degree of freedom of the structure of the center duct.

An object of the present invention is to provide a saddle riding vehicle having a duct structure capable of increasing the degree of freedom of the structure while achieving both of increase of the rigidity and reduction of the weight.

Solution to Problem

In a saddle riding vehicle, in which an intake duct (51) is provided inside an upper cowl (41) configuring an upper portion of the front portion of a cowl (40), and the intake duct (51) is supported by a body frame (10) and is extended in a vehicle longitudinal direction, the intake duct (51) has a front-rear two-split structure, and includes a base side member (52) and a distal end member (53), the base side member (52) being connected to the body frame (10), the distal end member (53) being connected to the base side member (52), the base side member (52) includes a body frame connection portion (52*x*) connected to the body frame (10) and is attached with a stay (55) supporting the cowl (40) and a meter (48), and the distal end member (53) is directed forward from the base side member (52).

In the configuration described above, it is also possible that, in the base side member (52), an inner dimension of a front end portion (52*b*) is expanded for a portion located rearward of the front end portion (52*b*), and a rear end portion (53*c*) of the distal end member (53) is inserted and connected to the front end portion (52*b*) of the base side member (52).

Also, in the configuration described above, it is also possible that the intake duct (51) has an S-shape in a side view, and the base side member (52) and the distal end member (53) curve in the vertically reverse direction.

Also, in the configuration described above, it is also possible that a connection portion (51*a*) of the base side member (52) and the distal end member (53) becomes a portion for switching the curving direction.

Also, in the configuration described above, it is also possible that the intake duct (51) extends so as to be directed downward to the front from a side of the body frame (10), and the height of a distal end portion upper portion (53L) of the distal end member (53) is lower than the height of a rear end portion upper portion (53U) of the distal end member (53).

Also, in the configuration described above, it is also possible that a front stay (58) is provided on an upper surface of a distal end portion of the base side member (52), the front stay (58) extending forward beyond the distal end of the base side member (52), and a body forming component (56) is disposed above the distal end member (53), the body forming component (56) being supported by the front stay (58).

Also, in the configuration described above, it is also possible that the body forming component (56) is disposed between the front stay (58) and the distal end member (53).

Also, in the configuration described above, it is also possible that the stay (55) is disposed on the upper surface of the base side member (52), and another body forming component (57) is disposed on a lower side of a straight line (73) that passes a distal end portion (58*d*) of the front stay (58) and an upper end portion (55*h*) of the stay (55).

Also, in the configuration described above, it is also possible that the body forming component is a camera (56) photographing the front of the vehicle body, and another body forming component is a junction box (57).

Advantageous Effects of Invention

The intake duct of a saddle riding vehicle has a front-rear two-split structure, and includes the base side member and the distal end member, the base side member being connected to the body frame, the distal end member being connected to the base side member, the base side member includes the body frame connection portion connected to the body frame and is attached with the stay supporting the cowl and the meter, and the distal end member is directed forward from the base side member. Accordingly, by employing the front-rear two-split structure for the intake duct, the degree of freedom of the structure can be increased such that the rigidity of the base side member is increased (the sheet thickness is changed, and so on), or that the distal end member is shaped into a simple tubular shape and the weight is reduced (the thickness is thinned, and so on) without affecting the rigidity, and so on. Thus, it is allowed to arrange the stay in the base side member that is on the body frame side and has high rigidity, and to support the cowl and the meter.

In the configuration described above, the distal end portion of the base side member is expanded in the diameter, and the rear end portion of the distal end member is inserted and connected to the front end portion of the base side member. Accordingly, the rigidity can be increased because connection is effected by a simple structure and the rear end portion of the distal end member is inserted to the front end portion of the base side member.

Also, in the configuration described above, the intake duct has an S-shape in a side view, and the base side member and the distal end member curve in the vertically reverse direction. Accordingly, by employing the front-rear two-split structure, the intake duct can be simply made to have a complicated shape.

Also, in the configuration described above, the connection portion of the base side member and the distal end member becomes a portion for switching the curving direction. Accordingly, the connection portion can be formed easily, and the base side member and the distal end member can be easily connected to each other by the connection portion.

Also, in the configuration described above, the intake duct extends so as to be directed downward to the front from the body frame side, and the height of the distal end portion upper portion of the distal end member is lower than the height of a rear end portion upper portion of the distal end member. Accordingly, a large space above the distal end portion of the distal end member can be secured.

Also, in the configuration described above, the front stay is provided on the upper surface of the distal end portion of the base side member, the front stay extending forward beyond the distal end of the base side member, and the body forming component is disposed above the distal end member, the body forming component being supported by the front stay. Accordingly, it is allowed to dispose the body forming component utilizing the space above the distal end member, and the body forming component can be disposed so as to be lower.

Also, in the configuration described above, the body forming component is disposed between the front stay and the distal end member. Accordingly, the space between the front stay and the distal end member can be utilized effectively, and it is facilitated to determine the height position of the body forming component by the front stay and to layout the body forming component.

Also, in the configuration described above, the stay is disposed on the upper surface of the base side member, and another body forming component is disposed on the lower side of the straight line that passes the distal end portion of the front stay and the upper end portion of the stay. Accordingly, the space determined by the front stay and the stay can be utilized effectively in the space on the upper surface side of the intake duct that is directed downward to the front.

Also, in the configuration described above, the body forming component is the camera photographing the front of the vehicle body, and another body forming component is the junction box. Accordingly, it is allowed to photograph the front of the vehicle during traveling and to record the image by the camera, and the wiring of the electric component can be efficiently cabled through the junction box.

DESCRIPTION OF EMBODIMENTS

Figure 1:
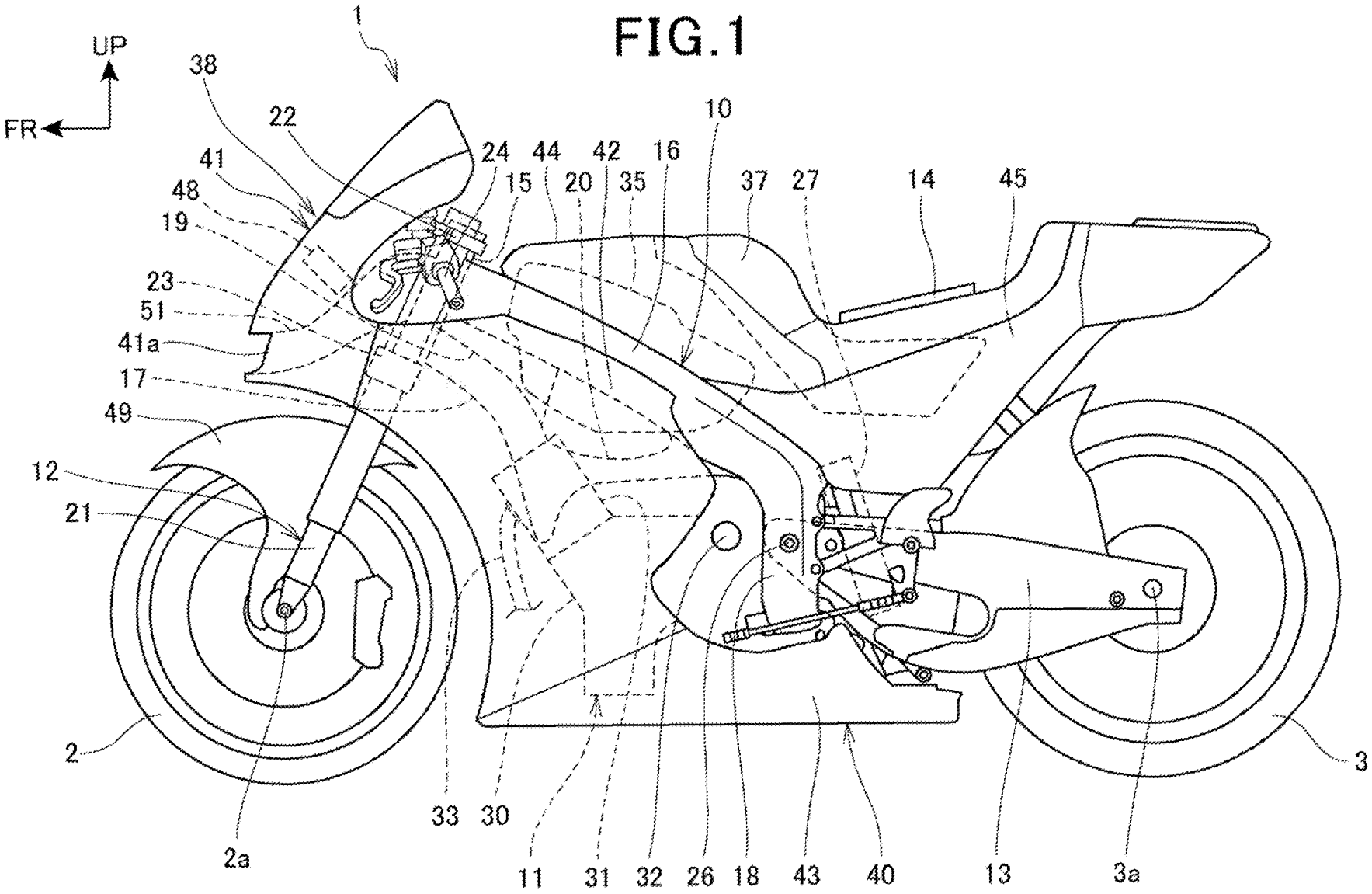
FIG. 1 is a left side view that shows a motorcycle according to an embodiment of the present invention.

Below, an embodiment of the present invention will be explained referring to the drawings. Also, in the explanation, description of the direction such as the front, rear, left, right, top, and bottom is the same as the direction with respect to the vehicle body unless stated otherwise in particular. Further, the reference sign FR shown in each drawing expresses vehicle forward, the reference sign UP expresses vehicle upward, and the reference sign LH expresses vehicle left hand.

FIG. 1 is a left side view that shows a motorcycle 1 according to an embodiment of the present invention.

The motorcycle 1 is a vehicle in which an engine 11 is supported by a body frame 10, front forks 12 steerably supporting a front wheel 2 are steerably supported by the front end portion of the body frame 10, and a swing arm 13 supporting a rear wheel 3 is arranged at the rear portion of the body frame 10. The motorcycle 1 is a saddle riding vehicle in which an occupant straddlingly sits on a seat 14, and the seat 14 is arranged above the rear portion of the body frame 10.

The body frame 10 includes a head pipe 15 positioned at the center in the vehicle width direction, a pair of left and right main frames 16, a pair of left and right down frames 17, a pair of left and right pivot frames 18, a pair of left and right seat frames (not illustrated), and a pair of left and right gussets 19.

The head pipe 15 is arranged at the front end of the body frame 10, and supports the front forks 12. The main frame 16 extends downward to the rear from the upper portion of the head pipe 15. The down frame 17 extends downward to the rear from the lower portion of the head pipe 15.

The pivot frame 18 extends downward from the rear end portion of the main frame 16. The seat frame extends rearward from the rear end portion of the main frame 16, and supports the seat 14. The gusset 19 vertically connects the front end portion of the main frame 16 and the front end portion of the down frame 17 to each other. The lower end portion of the down frame 17 and the rear portion of the main frame 16 are connected to each other by a connection portion 20 that extends in the vehicle longitudinal direction.

The front forks 12 include a steering shaft (not illustrated), a pair of left and right fork pipes 21, a top bridge 22, a bottom bridge 23, and a steering handlebar 24.

The steering shaft is turnably supported by the head pipe 15. The left and right fork pipes 21 are telescopic type shock absorbers. The top bridge 22 is fixed to the upper end of the steering shaft, and connects the upper portions of the left and right fork pipes 21 to each other. The bottom bridge 23 is fixed to the lower end of the steering shaft, and connects the left and right fork pipes 21 to each other. The steering handlebar 24 is fixed to the upper portion of the fork pipes 21.

The front wheel 2 is supported by a front wheel axle 2*a* that is stretched between the lower end portions of the left and right fork pipes 21.

The swing arm 13 is supported by a pivot shaft 26 at the front end portion, the pivot shaft 26 being stretched between the left and right pivot frames 18, and is vertically swingable around the pivot shaft 26.

The rear wheel 3 that is a driving wheel is supported by a rear wheel axle 3*a* that is arranged at the rear end portion of the swing arm 13.

The swing arm 13 is connected to the vehicle body through a cushion unit 27.

The engine 11 is disposed below the main frame 16 and between the down frames 17 and the pivot frames 18, and is supported by the body frame 10.

The engine 11 includes a crankcase 30 and a cylinder portion 31, the crankcase 30 storing a crankshaft (not illustrated) that extends in the vehicle width direction (the left-right direction), the cylinder portion 31 extending upward from the upper portion of the front portion of the crankcase 30.

At the rear portion of the crankcase 30, a transmission (not illustrated) is incorporated, the transmission decelerating and outputting rotation of the engine 11. The output of the engine 11 is transmitted to the rear wheel 3 through a driving chain (not illustrated) that is stretched between an output shaft 32 of the transmission and the rear wheel 3.

An exhaust pipe 33 of the engine 11 is drawn out downward from an exhaust port located at the front surface of the cylinder portion 31, passes below the crankcase 30, and extends rearward.

An air cleaner box 35 of the intake system of the engine 11 is disposed above the engine 11 and between the left and right main frames 16. In a vehicle side view, the main frames 16 overlap with the air cleaner box 35 from the outer side. In the vehicle longitudinal direction, the air cleaner box 35 is disposed between the head pipe 15 and a fuel tank 37.

The intake air purified by the air cleaner box 35 passes through an intake passage (not illustrated), and flows to an intake port of the cylinder portion 31.

The fuel tank 37 is disposed above the rear portion of the main frames 16, and is disposed between the seat 14 and the air cleaner box 35 in the vehicle longitudinal direction.

The motorcycle 1 includes a body cover 38 that covers the vehicle body.

The body cover 38 includes a cowl 40, an upper cover 44, and a rear cover 45, the cowl 40 covering the front portion and the lower portion of the vehicle body, the upper cover 44 covering the air cleaner box 35 from above, the rear cover 45 covering the rear portion of the vehicle body.

The cowl 40 includes an upper cowl 41, a pair of left and right middle cowls 42, and a lower cowl 43, the upper cowl 41 covering the upper portion of the front forks 12 and the head pipe 15 from the front, the middle cowls 42 covering the front portion of the body frame 10 and the engine 11 from the left and right sides, the lower cowl 43 covering the engine 11 and the body frame 10 from below.

In the front surface of the upper cowl 41, an opening 41*a* taking in the travelling air is formed, and the front end portion of an intake duct 51 is connected to the edge portion of the opening 41*a*, the intake duct 51 guiding the travelling air to the air cleaner box 35 side.

Between the upper cowl 41 and the head pipe 15, a meter 48 is disposed, the meter 48 displaying information such as the vehicle speed.

A front fender 49 is supported by the left and right fork pipes 21.

Figure 2:
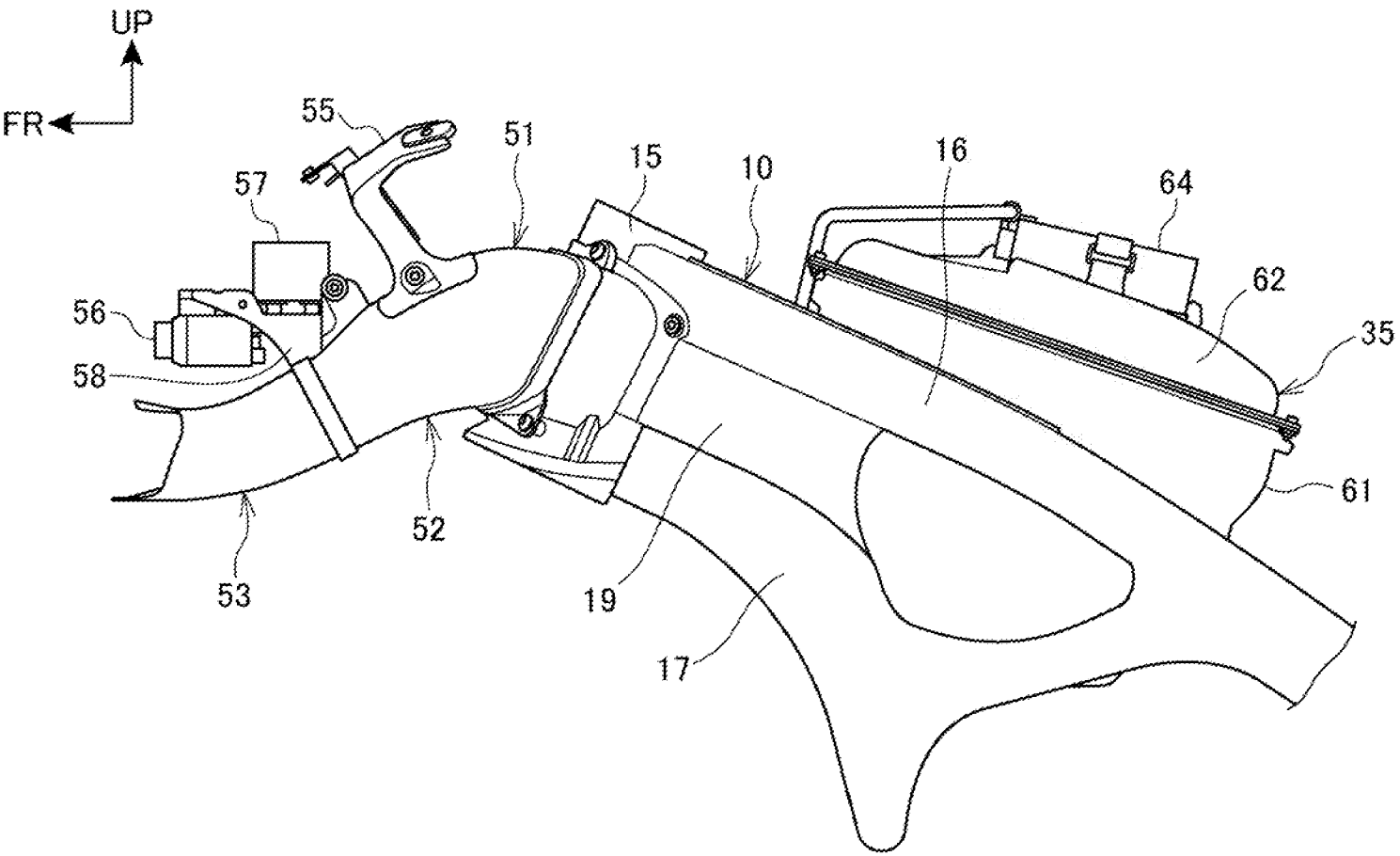
FIG. 2 is a left side view that shows a body frame, an air cleaner box, and an intake duct.

FIG. 2 is a left side view that shows the body frame 10, the air cleaner box 35, the intake duct 51.

In front of the head pipe 15 of the body frame 10, the intake duct 51 is disposed.

The intake duct 51 is a component having a two-split structure configured of a rear duct 52 and a front duct 53, the rear duct 52 being arranged on the head pipe 15 side, the rear end portion of the front duct 53 being connected to the front end portion of the rear duct 52.

By the rear duct 52, a rear stay 55 and a front stay 58 are supported, the rear stay 55 supporting the upper cowl 41 (refer to FIG. 1), the meter 48 (refer to FIG. 1) being attached to the rear stay 55, the front stay 58 supporting a camera 56 and a junction box 57, the camera 56 photographing the front of the vehicle, the junction box 57 storing connection portions of wiring of the electric component. The camera 56 may have a function of recording a photographed image, or may be attached with a recorder having a recording function.

The air cleaner box 35 includes a box body 61 and a box cover 62, and is disposed between the left and right main frames 16, the box body 61 having a box shape with the upper portion being opened, the box cover 62 closing the upper opening of the box body 61.

To the upper portion of the box cover 62, an ECU (Electronic Control Unit) 64 is attached. Here, an engine control unit controlling the engine 11 (refer to FIG. 1) is also included in the ECU 64.

The ECU 64 is covered by the fuel tank 37 (refer to FIG. 1) and the upper cover 44 (refer to FIG. 1) from above.

Figure 3:
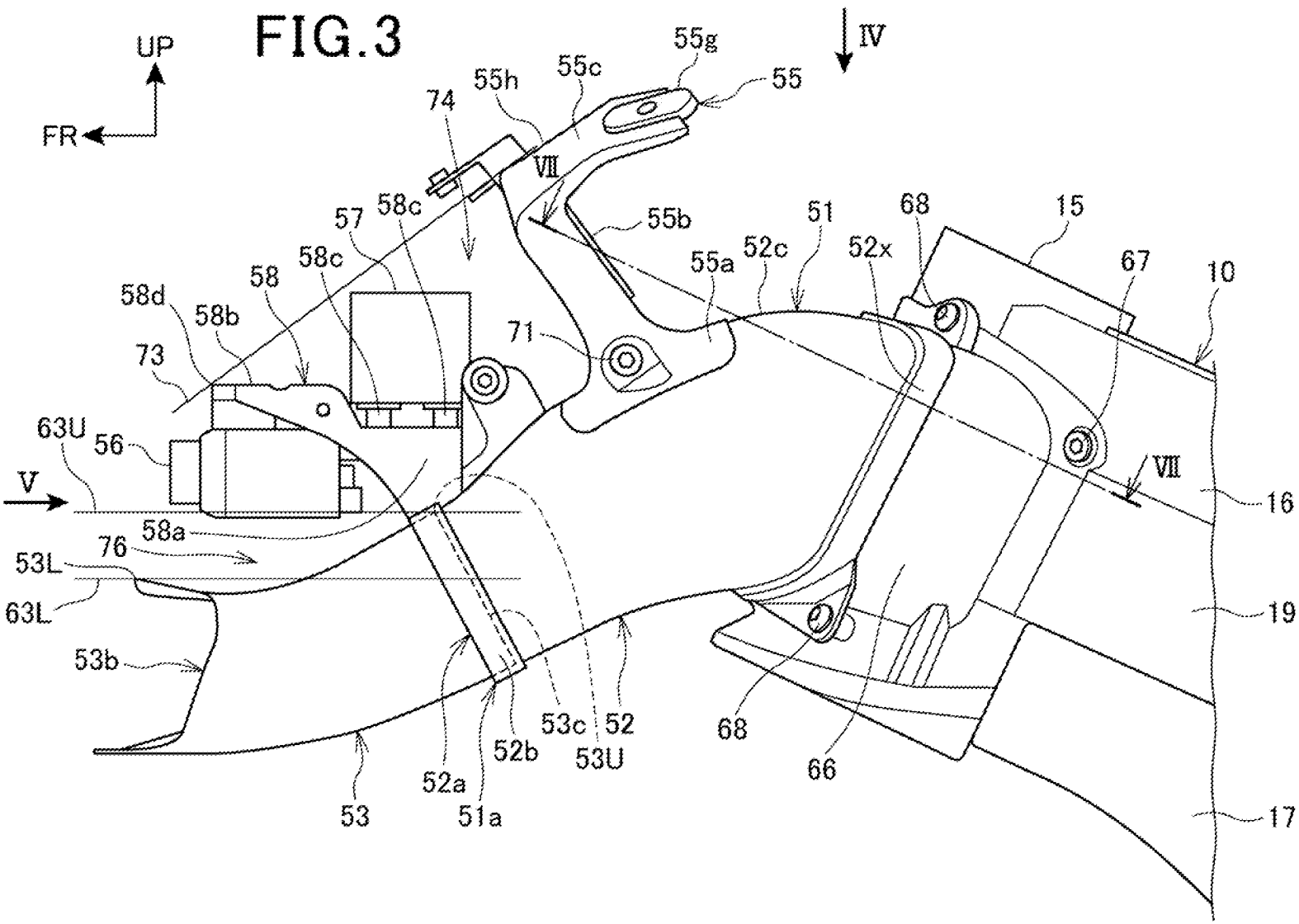
FIG. 3 is an enlarged view of an essential portion of FIG. 2.
Figure 4:
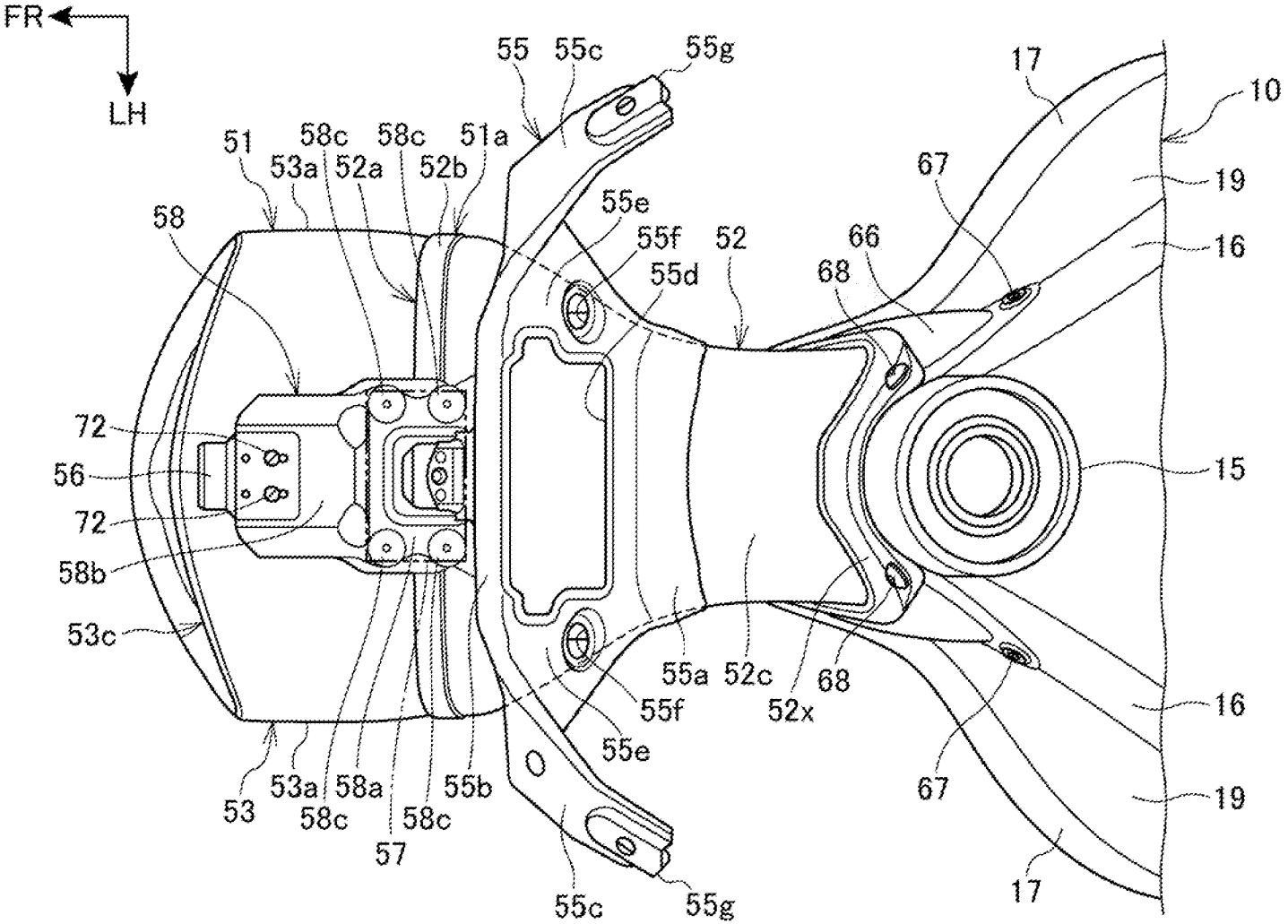
FIG. 4 is a drawing as viewed along the arrow IV of FIG. 3.
Figure 5:
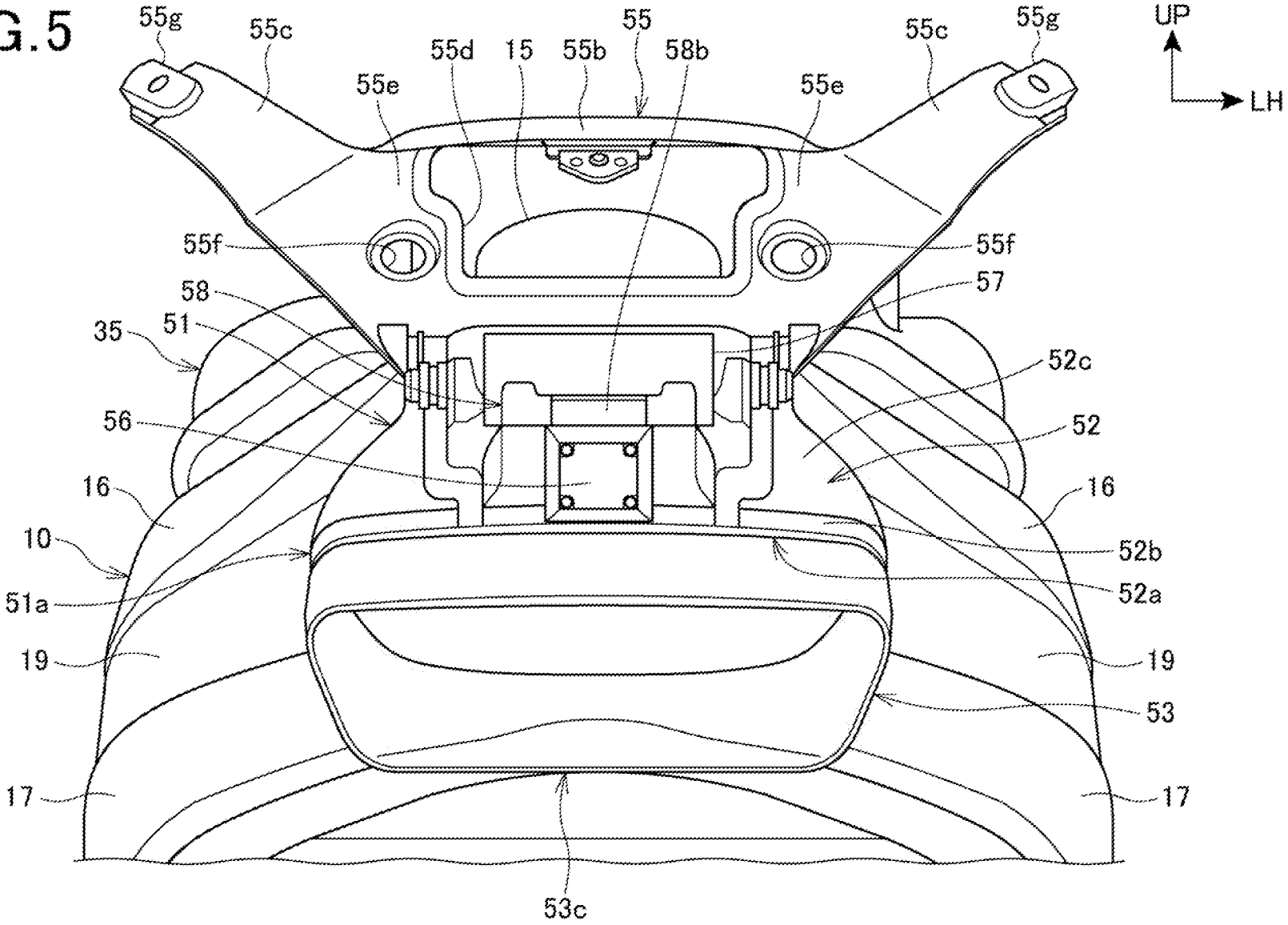
FIG. 5 is a drawing as viewed along the arrow V of FIG. 3.

FIG. 3 is an enlarged view of an essential portion of FIG. 2, FIG. 4 is a drawing (plan view) as viewed along the arrow IV of FIG. 3, and FIG. 5 is a drawing (front view) as viewed along the arrow V of FIG. 3.

As shown in FIG. 3 to FIG. 5, a duct support member 66 is attached to the body frame 10, to be more specific, to the head pipe 15, the left and right main frames 16, the left and right down frames 17, and the left and right gussets 19 by a plural number of bolts 67. The duct support member 66 configures a part of the body frame 10.

At the rear end portion of a rear duct 52 of the intake duct 51, a body frame connection portion 52*x* is arranged, and the body frame connection portion 52*x* is connected and attached by a plural number of bolts 68 to the duct support member 66.

In FIG. 3, in a vehicle side view, the rear duct 52 starts to extend toward a direction generally perpendicular to the head pipe 15 (obliquely upward to the front) from the duct support member 66, and thereafter curves obliquely downward to the front. That is to say, the rear end portion of the rear duct 52 is directed obliquely downward to the rear, the front end portion of the rear duct 52 is directed obliquely downward to the front, and the total of the rear duct 52 curves so as to project upward.

In a vehicle side view, the front duct 53 starts to extend obliquely downward to the front from the front end portion of the rear duct 52, and thereafter curves forward. That is to say, the rear end portion of the front duct 53 is directed obliquely upward to the rear, the front end portion of the front duct 53 is directed forward, and the total of the front duct 53 curves so as to project downward.

With respect to the front duct 53, the height of a distal end portion upper portion 53L is lower than the height of a rear end portion upper portion 53U. When horizontal lines 63U, 63L passing the rear end portion upper portion 53U and the distal end portion upper portion 53L respectively are drawn, in a vehicle side view, the horizontal line 63U overlaps with the lower portion of the camera 56, and the horizontal line 63L is positioned below the camera 56.

The total of the intake duct 51 has an S-shape in a vehicle side view.

In the intake duct 51, the position where the curving direction is switched from the upward projection to the downward projection is a connection portion 51*a* between the rear duct 52 and the front duct 53. The connection portion 51*a* includes an expanded portion 52*b* of the rear duct 52 which will be described below and a rear end portion 53*c* of the front duct 53.

In FIG. 3 to FIG. 5, with respect to the rear duct 52, the front end portion is wider than the rear end portion in the vehicle width direction, and the front end portion of the rear duct 52 has a flattened shape in which the width in the vehicle width direction is larger than the width in the vertical direction. An opening 52*a* formed at the front end portion of the rear duct 52 also has a flattened shape similarly to the above.

With respect to the front duct 53, left and right ends 53*a*, 53*a* (refer to FIG. 4) extend respectively in the vehicle longitudinal direction. The total of the front duct 53 has a flattened shape in which the width in the vehicle width direction is larger than the width in the vertical direction, and an opening 53*b* formed at the front end portion of the front duct 53 also has a flattened shape in which the width in the vehicle width direction is larger than the width in the vertical direction.

At the front end portion of the rear duct 52, the expanded portion 52*b* is formed, the inner dimension of the inner surface being increased for a portion behind the front end portion in the expanded portion 52*b*, and a rear end portion 53*c* of the front duct 53 is fitted into the expanded portion 52*b* of the rear duct 52 by pressing-in. Also, the rear end portion 53*c* of the front duct 53 and the expanded portion 52*b* of the rear duct 52 may be connected to each other by pressing-in and adhesion, or by pressing-in and fastening by a fastening member.

The rear stay 55 is arranged on an upper surface 52*c* of the intermediate portion of the length in the vehicle longitudinal direction in the rear duct 52, and includes a fixing portion 55*a*, a center portion 55*b*, and a pair of left and right inclined extension portions 55*c* in an integral manner.

The fixing portion 55*a* is formed along the upper surface 52*c* of the rear duct 52, and is fixed to the upper surface 52*c* of the rear duct 52 by a pair of left and right screws 71.

The center portion 55*b* is a portion having a contour of a generally rectangular shape that stands up from the fixing portion 55*a*, and includes a meter opening portion 55*d* and a pair of left and right meter support portions 55*e*, the meter 48 (refer to FIG. 1) being fitted into the meter opening portion 55*d*, the meter support portions 55*e* being arranged at both side edge portions of the meter opening portion 55*d* and supporting the meter 48 (refer to FIG. 1). In the meter support portions 55*e*, a meter support hole 55*f* is opened, the meter support hole 55*f* being for elastically supporting the meter 48 by a bolt and an elastic member.

The left and right inclined extension portions 55*c* respectively extend obliquely upward to a side from the both side edges of the center portion 55*b* in a vehicle front view, and are bent from the both side edges of the center portion 55*b* and extend obliquely upward to the rear in a vehicle side view. Cowl support portions 55*g* are provided at the distal end portions of the left and right inclined extension portions 55*c*, the cowl support portions 55*g* respectively supporting the upper cowl 41 (refer to FIG. 1).

As described above, the rear stay 55 doubles as a cowl stay that supports the upper cowl 41 and a meter stay that supports the meter 48.

The front stay 58 is positioned obliquely downward to the front from the rear stay 55, is adhered to or fixed by screws to the upper surface 52*c* of the front portion of the rear duct 52, and includes a box support portion 58*a* and a camera support portion 58*b*.

The box support portion 58*a* is a portion supporting the junction box 57, is formed into a rectangular shape in a plan view, and includes attaching portions 58*c* for the junction box 57 at respective corner portions of the rectangular shape.

The camera support portion 58*b* is a portion that extends forward from the front end portion of the box support portion 58*a* and supports the camera 56, and the upper surface of the camera support portion 58*b* is arranged at a position higher than the attaching portions 58*c* of the box support portion 58*a*. To the lower portion of the camera support portion 58*b*, the camera 56 is attached by a pair of left and right screws 72.

The junction box 57 is disposed, in a vehicle side view, in a space 74 surrounded by the rear duct 52, the rear stay 55, and the front stay 58 below a straight line 73 that passes an upper edge 55*h* of the cowl support portion 55*g* of the rear stay 55 and an upper surface distal end 58*d* of the camera support portion 58*b* of the front stay 58.

The camera 56 is disposed in a space 76 between the front duct 53 and the front stay 58 (to be more specific, the camera support portion 58*b*).

Figure 6:
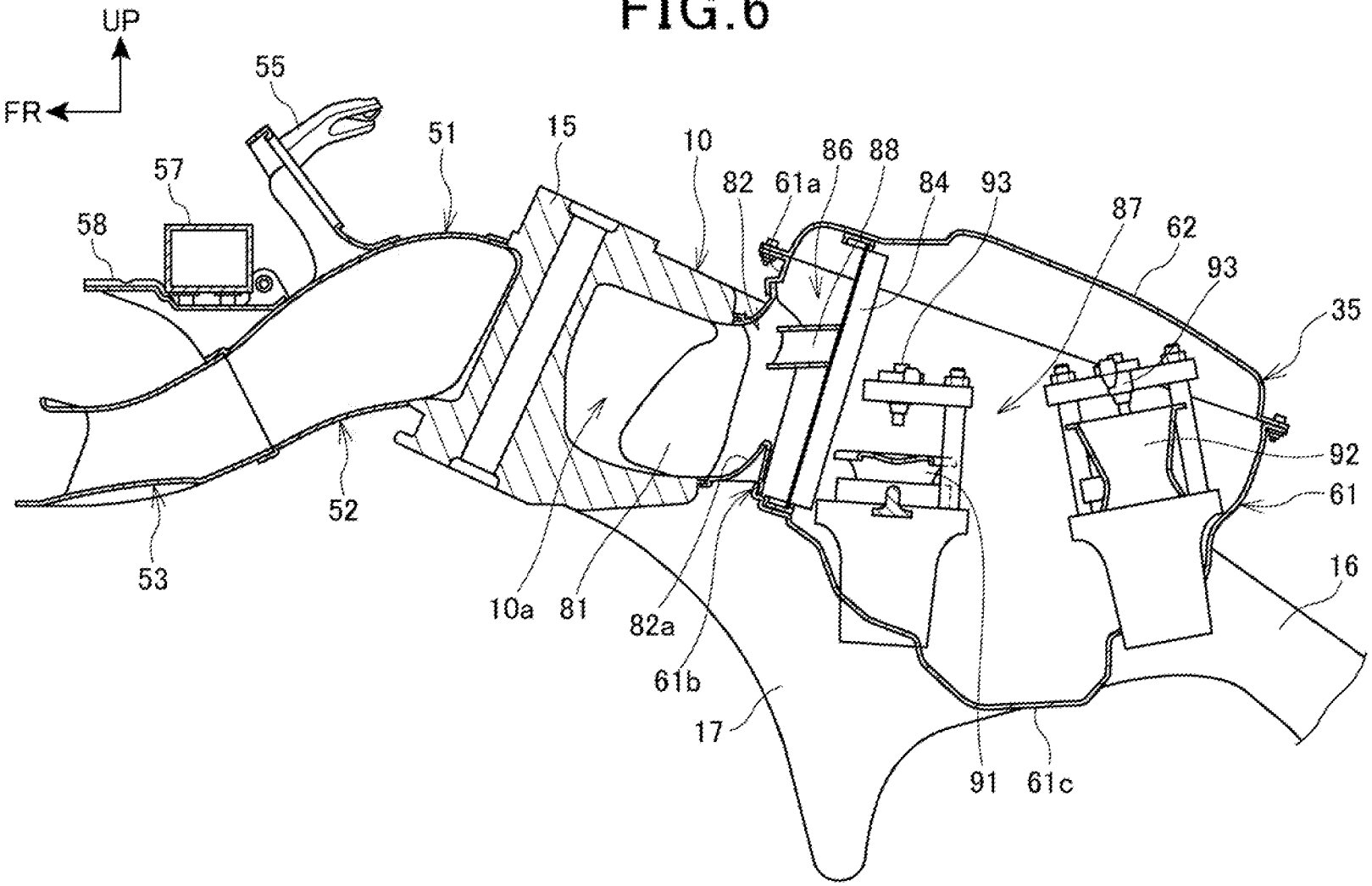
FIG. 6 is a cross-sectional view when the body frame, the air cleaner box, and the intake duct are cut vertically on the vehicle body center line that extends in the vehicle longitudinal direction.

FIG. 6 is a cross-sectional view when the body frame 10, the air cleaner box 35, and the intake duct 51 are cut vertically on the vehicle body center line that extends in the vehicle longitudinal direction.

The body frame 10 includes an intake passage 10*a* that passes the left and right lateral sides of the head pipe 15 and extends to the rear of the head pipe 15.

To the front end portion of the intake passage 10*a*, the intake duct 51 (to be more specific, the rear duct 52) is connected. To the inner peripheral surface of the rear end portion of the intake passage 10*a*, an attachment 81 having a tubular shape is adhered. Also, to the rear edge of the attachment 81, the front edge of the joint 82 having a tubular shape is fittingly connected.

The joint 82 includes a guide portion 82*a* on the inner surface of the lower portion, the guide portion 82*a* guiding the air upward.

The rear edge of the joint 82 is connected to the edge of an opening 61*b* that is formed in a front wall 61*a* of the box body 61.

The air cleaner box 35 includes a filter element 84 in the inner portion, the filter element 84 being disposed vertically so as to stretch between the box body 61 and the box cover 62, the front surface of the filter element 84 being directed vehicle forward.

The filter element 84 is a component that purifies the air introduced through the intake duct 51 and the intake passage 10*a*. By the filter element 84, the inside of the air cleaner box 35 is separated into a dirty side 86 on the intake passage 10*a* side and a clean side 87 on the rear side of the air cleaner box 35.

The filter element 84 includes an air guide port 88 that protrudes into the dirty side 86.

The air guide port 88 works to guide a part of the flow of the air inside the dirty side 86 toward the upper portion of the inside of the clean side 87.

Inside the clean side 87, a plural number of throttle bodies (not illustrated), a plural number of air funnels 91, 92 and injectors 93 are disposed, the air funnels 91, 92 being attached to the upper portions of the respective throttle bodies, the injectors 93 being respectively disposed so as to face the openings of the air funnels 91, 92. The respective injectors 93 inject fuel into the air funnels 91, 92 respectively, and supply the fuel to respective cylinders of the engine 11.

The throttle body described above penetrates a bottom wall 61*c* of the box body 61, and is connected to the cylinder portion 31 (refer to FIG. 1) of the engine 11 (refer to FIG. 1).

By arranging the air guide port 88 in the filter element 84 as described above, directivity is given to the air flowing into the clean side 87, and it is possible to make the air flow toward the upper portion of the inside of the clean side 87.

Figure 7:
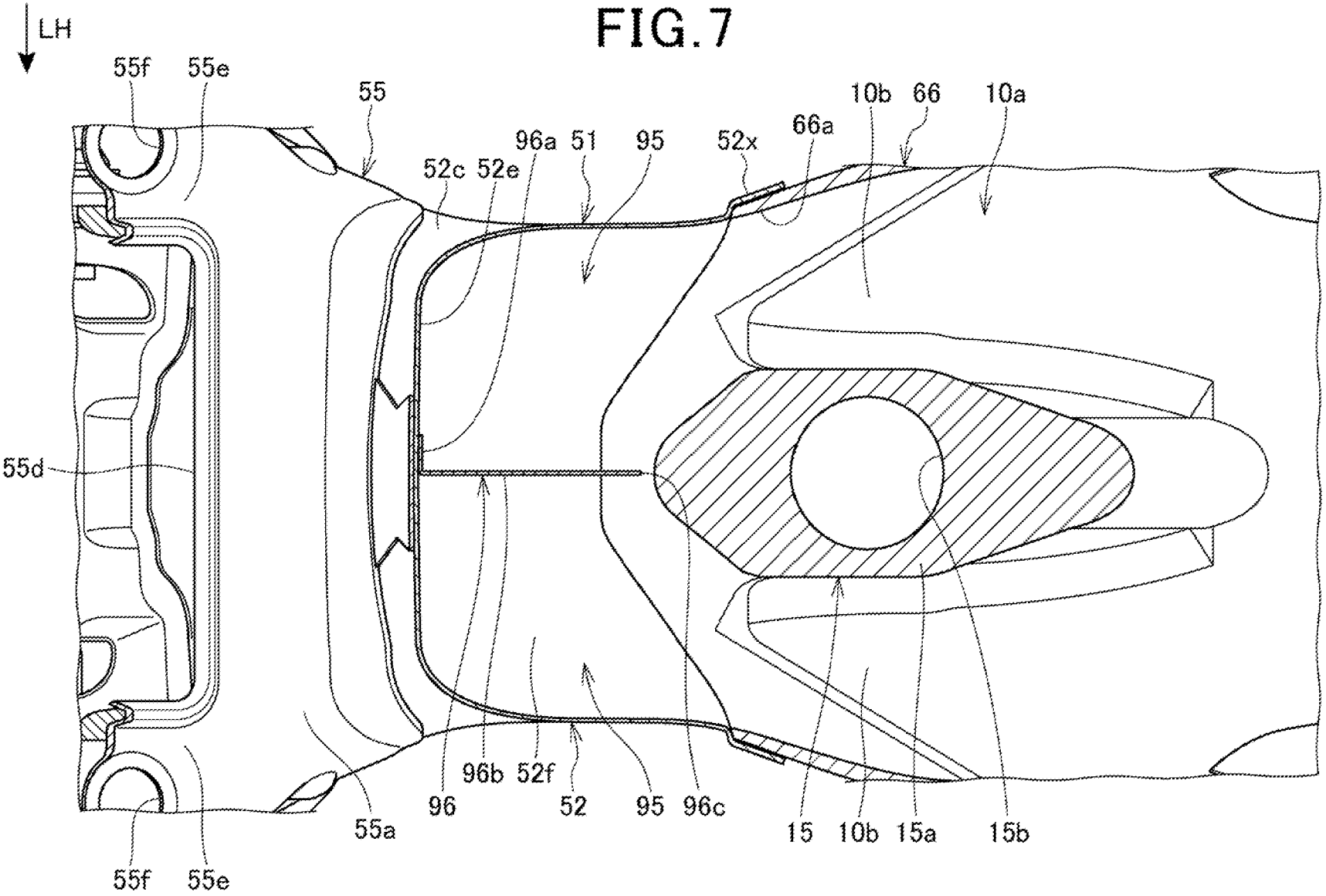
FIG. 7 is a cross-sectional view taken along the line VII-VII of FIG. 3.

FIG. 7 is a cross-sectional view taken along the line VII-VII of FIG. 3.

The rear duct 52 includes the body frame connection portion 52*x* at the edge of the rear end portion, the body frame connection portion 52*x* having a tubular shape, and the body frame connection portion 52*x* is fitted into the outer side of a fitted portion 66*a* having a tubular shape formed at the edge of the front end of the duct support member 66 while keeping airtightness.

To an upper inner surface 52*e* that is the inner surface of the upper surface 52*c* of the rear duct 52, a separation wall 96 is attached, the separation wall 96 separating the inside of the rear duct 52 into ducted passages 95, 95 on both sides in the vehicle width direction. The separation wall 96 includes a base portion 96*a* and a separation portion 96*b*, the base portion 96*a* being attached to the center portion in the vehicle width direction of the upper inner surface 52*e*, the separation portion 96*b* having a flat sheet shape extending from the side edge portion of the base portion 96*a* toward a lower inner surface 52*f* that is the inner surface facing the upper inner surface 52*e*. A rear end 96*c* of the separation portion 96*b* is adjacent to the front end of an intermediate portion 15*a* of the head pipe 15.

By arranging the separation wall 96 inside the rear duct 52 as described above, the flow of the air inside the intake duct 51 can be rectified beforehand inside the left and right ducted passages 95, 95, and the air can be made to flow through a pair of left and right branched passages 10*b* formed in the intake passage 10*a*. Thereby, the air inside the rear duct 52 and inside the intake passage 10*a* can be made to flow more smoothly. Also, the rigidity of the rear duct 52 can be enhanced by the separation wall 96. Thereby, the supporting rigidity in supporting other components by the rear duct 52 is enhanced, and the sheet thickness of the rear duct 52 can be thinned to achieve weight reduction.

The head pipe 15 is formed into a streamlined shape with respect to the cross-sectional outer shape of the intermediate portion 15*a* in the longitudinal direction, and includes a shaft insertion hole 15*b* to which the steering shaft described above is inserted.

The left and right branched passages 10*b* of the intake passage 10*a* are formed respectively on both of the lateral sides in the vehicle width direction of the head pipe 15.

By forming the cross-sectional shape of the head pipe 15 into a streamlined shape as described above, occurrence of turbulence in the flow of the air flowing into the intake passage 10*a* can be suppressed, and the flow of the air can be made smoother.

Figure 8:
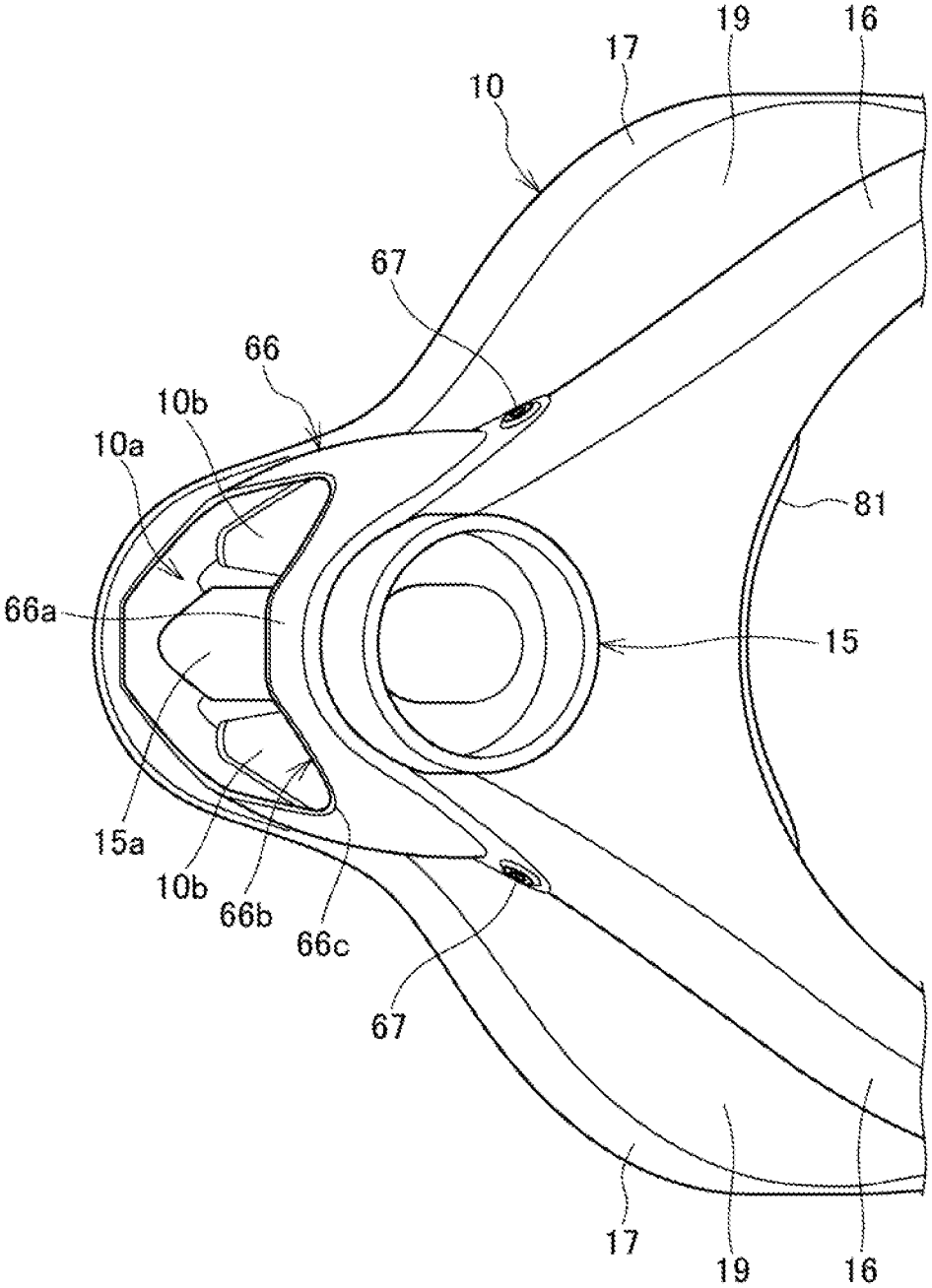
FIG. 8 is a plan view that shows the front portion of the body frame.
Figure 9:
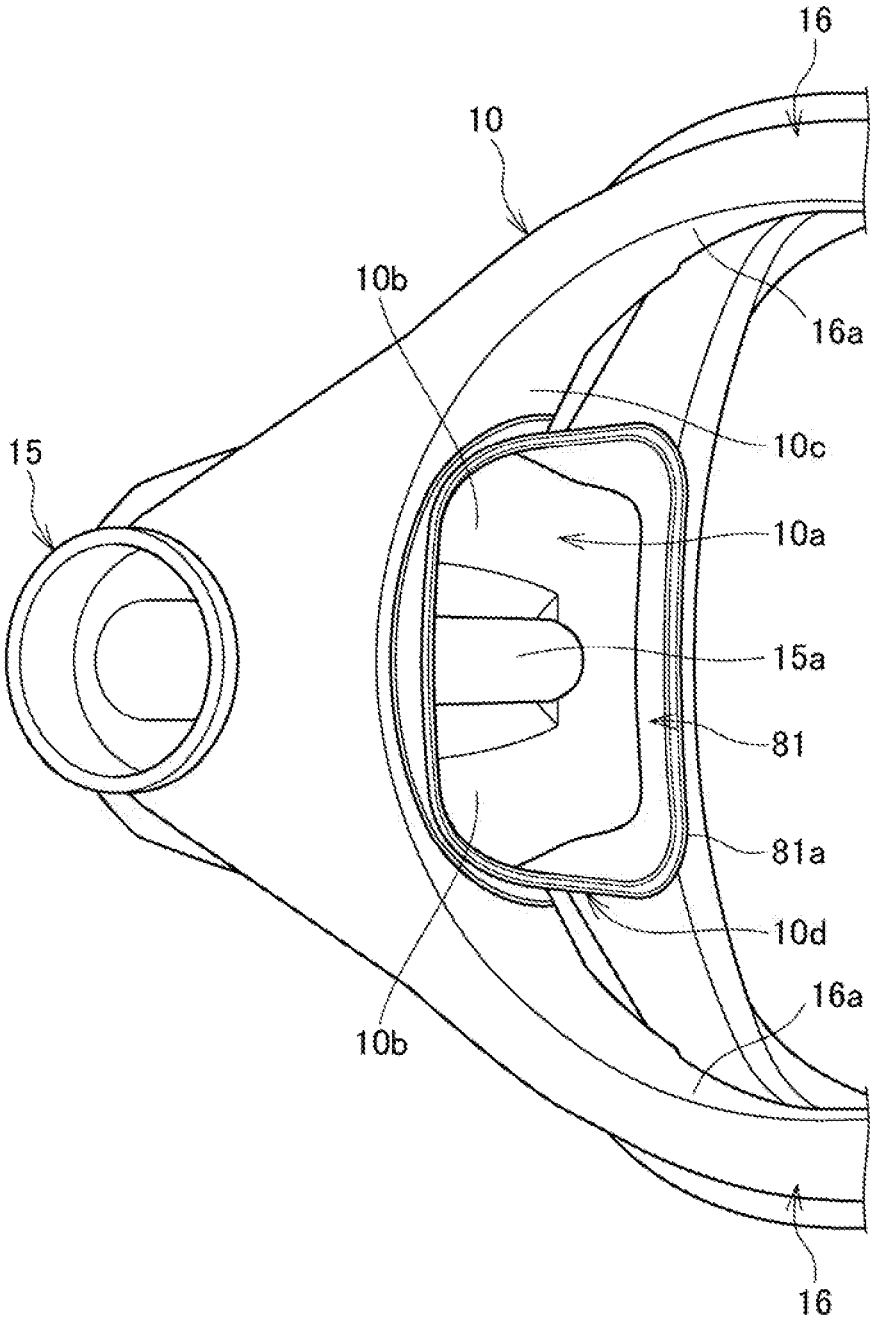
FIG. 9 is a perspective view when the body frame is viewed from obliquely above.

FIG. 8 is a plan view that shows the front portion of the body frame 10, and FIG. 9 is a perspective view when the body frame 10 is viewed from obliquely above.

As shown in FIG. 8, the duct support member 66 of the body frame 10 includes a front opening 66*b* at the front end portion, and the intake passage 10*a* is formed behind the front opening 66*b*.

An edge portion 66*c* of the front opening 66*b* protrudes forward beyond the head pipe 15 at the center portion in the vehicle width direction and is formed so as to be positioned gradually rearward as it goes outward in the vehicle width direction from the center portion in the vehicle width direction, and the fitted portion 66*a* having a tubular shape is arranged so as to follow the edge portion 66*c*.

In FIG. 7 and FIG. 8, the rear duct 52 is attached to respective distal end portions of the head pipe 15, the left and right main frames 16, the left and right down frames 17, and the left and right gussets 19 through the duct support member 66. Thereby, the fitted portion 66*a* having a tubular shape can be formed easily, the body frame connection portion 52*x* having a tubular shape of the rear duct 52 being connected to the fitted portion 66*a*, and airtightness of the body frame connection portion 52*x* and the fitted portion 66*a* can be further enhanced.

As shown in FIG. 9, on inner walls 16*a*, 16*a* of the left and right main frames 16 in the body frame 10, a wall behind head pipe 10*c* is continuingly arranged, the wall behind head pipe 10*c* being disposed behind the head pipe 15.

In the wall behind head pipe 10*c*, a rear opening 10*d* of the intake passage 10*a* is formed. The rear opening 10*d* is formed into a generally rectangular shape, and the attachment 81 is arranged over a range from the rear opening 10*d* to the inner surface of the intake passage 10*a*. A rear edge portion 81*a* of the attachment 81 is inserted and connected to a fitting groove that is formed at the front edge of the joint 82 (refer to FIG. 6).

As shown in FIG. 1 and FIG. 3 above, the motorcycle 1 as a saddle riding vehicle includes the intake duct 51 inside the upper cowl 41 that configures the upper portion of the front portion of the cowl 40, and the intake duct 51 is supported by the front end portion of the body frame 10 and extends to the front and rear of the vehicle body.

The intake duct 51 has a front-rear two-split structure, and includes the rear duct 52 as a base side member connected to the body frame 10 and the front duct 53 as a distal end member connected to the rear duct 52.

The rear duct 52 includes the body frame connection portion 52*x* that is connected to the body frame 10 and is attached with the rear stay 55 as a stay that supports the cowl 40 and the meter 48, and the front duct 53 is directed forward from the rear duct 52.

With this configuration, by employing the front-rear two-split structure for the intake duct 51, the degree of freedom of the structure can be increased such that the rigidity of the rear duct 52 is increased (the sheet thickness is changed, and so on), or that the front duct 53 is shaped into a simple tubular shape and the weight is reduced (the thickness is thinned, and so on) without affecting the rigidity, and so on. Thus, it is allowed to arrange the stays (the rear stay 55 and the front stay 58) in the rear duct 52 that is on the body frame 10 side and has high rigidity, and to support the cowl 40 and the meter 48.

Also, as shown in FIG. 3, with respect to the rear duct 52, the inner dimension of the expanded portion 52*b* as the front end portion is expanded with respect to a portion behind the expanded portion 52*b*, and the rear end portion 53*c* of the front duct 53 is inserted and connected to the expanded portion 52*b* of the rear duct 52.

With this configuration, the rear duct 52 and the front duct 53 can be connected to each other with a simple structure, and the rigidity of the intake duct 51 can be increased by inserting the rear end portion 53*c* of the front duct 53 to the expanded portion 52*b* of the rear duct 52.

Also, the intake duct 51 has an S-shape in a side view, and the rear duct 52 and the front duct 53 curve in the vertically reverse direction. Accordingly, by employing the front-rear two-split structure for the intake duct 51, the intake duct 51 can be simply formed into a complicated shape.

Also, the connection portion 51*a* of the rear duct 52 and the front duct 53 becomes a portion for switching the curving direction. Accordingly, the connection portion 51*a* can be easily formed into a generally straight shape, and the rear duct 52 and the front duct 53 can be easily connected to each other by the connection portion 51*a*.

Also, the intake duct 51 extends so as to be directed downward to the front from the body frame 10 side, and the height of the distal end portion upper portion 53L of the front duct 53 becomes lower than the height of the rear end portion upper portion 53U of the front duct 53. Accordingly, the large space 76 above the front end portion of the front duct 53 can be secured.

Also, the front stay 58 is provided on the upper surface of the distal end portion of the rear duct 52, the front stay 58 extending forward beyond the distal end of the rear duct 52, and the camera 56 as a body forming component is disposed above the front duct 53, the camera 56 being supported by the front stay 58.

With this configuration, it is allowed to dispose the camera 56 utilizing the space 76 above the front duct 53, and the camera 56 can be disposed so as to be lower.

Also, the camera 56 is disposed between the front stay 58 and the front duct 53. Accordingly, the space 76 between the front stay 58 and the front duct 53 can be utilized effectively, and it is facilitated to determine the height position of the camera 56 by the front stay 58 and to layout the camera 56.

Also, the rear stay 55 is disposed on the upper surface of the rear duct 52, and the junction box 57 as another body forming component is disposed on the lower side of the straight line 73 that passes the distal end portion of the front stay 58 (to be more specific, the upper surface distal end 58*d* of the camera support portion 58*b*) and the upper end portion of the rear stay 55 (to be more specific, the upper edge 55*h* of the cowl support portion 55*g*).

With this configuration, the space 74 determined by the front stay 58 and the rear stay 55 can be utilized effectively in the space on the upper surface side of the intake duct 51 that is directed downward to the front.

Also, the body forming component is the camera 56 photographing the front of the vehicle body, and another body forming component is the junction box 57. Accordingly, it is allowed to photograph the front of the vehicle during traveling and to record the image by the camera 56, and the wiring of the electric component can be efficiently cabled through the junction box 57.

The embodiment described above only shows an aspect of the present invention, and alteration and application are optionally possible within a range not departing from the gist of the present invention.

For example, although the intake duct 51 is attached to the front end portion of the body frame 10 through the duct support member 66 as shown in FIG. 3 in the embodiment described above, the present invention is not limited to it, and the intake duct 51 may be attached directly to the front end portion of the body frame 10.

Further, although the rear stay 55 and the front stay 58 are arranged separately in the rear duct 52 as shown in FIG. 3, the present invention is not limited to it, and the rear stay 55 and the front stay 58 may be arranged in an integral manner.

The present invention is not limited to a case of being applied to the motorcycle 1, and can be applied also to saddle riding vehicles including those other than the motorcycle 1. Also, the saddle riding vehicle includes all vehicles where an occupant rides saddling the vehicle body, and is a vehicle not only a motorcycle (inclusive of a bicycle with an engine) but also a three wheeled vehicle and a four wheeled vehicle classified to an ATV (All Terrain Vehicle).

REFERENCE SIGNS LIST

1 . . . Motorcycle (saddle riding vehicle)
10 . . . Body frame
40 . . . Cowl
41 . . . Upper cowl
48 . . . Meter
51 . . . Intake duct
52 . . . Rear duct (base side member)
52*b* . . . Expanded portion (front end portion)
52*x* . . . Body frame connection portion
53 . . . Front duct (distal end member)
53*c* . . . Rear end portion
53L . . . Distal end portion upper portion
53U . . . Rear end portion upper portion
55 . . . Rear stay (stay)
55*h* . . . Upper edge (upper end portion) of cowl support portion)
56 . . . Camera (body forming component)
57 . . . Junction box (another body forming component)
58 . . . Front stay
58*d* . . . Upper surface distal end (distal end portion)
73 . . . straight line

The invention claimed is:

1. A saddle riding vehicle, in which an intake duct is provided inside an upper cowl configuring an upper portion of the front portion of a cowl, and the intake duct is supported by a body frame and is extended in a vehicle longitudinal direction, wherein the intake duct has a front-rear two-split structure, and includes a base side member and a distal end member, the base side member being formed as a separate part from a head pipe of the body frame and being connected to the body frame, the distal end member being formed as a separate part from the base side member and being connected to the base side member, the base side member includes a body frame connection portion connected to the body frame, said base side member has a rear stay attached thereto, said rear stay supporting the cowl and a meter, the distal end member is directed forward from the base side member, the intake duct extends so as to be directed downward to the front from a side of the body frame, a height of a front end portion upper portion of the distal end member is lower than a height of a rear end portion upper portion of the distal end member, a front stay is provided on an upper surface of a front end portion of the base side member, the front stay extending forward beyond the front end of the base side member, and a camera photographing the front of the vehicle body is disposed above the distal end member, the camera being supported by the front stay, the front stay is provided at a position lower than a highest position of an upper surface of the base side member, the camera is disposed between the front stay and the distal end member.

2. The saddle riding vehicle according to claim 1, wherein, in the base side member, an inner dimension of a front end portion is expanded for a portion located rearward of the front end portion, and a rear end portion of the distal end member is inserted and connected to the front end portion of the base side member.

3. The saddle riding vehicle according to claim 1, wherein the intake duct has an S-shape in a side view, and the base side member and the distal end member curve in the vertically reverse direction.

4. The saddle riding vehicle according to claim 3, wherein a connection portion of the base side member and the distal end member is a portion for switching the curving direction.

5. The saddle riding vehicle according to claim 1, wherein the rear stay is disposed on the upper surface of the base side member, and a junction box is disposed on a lower side of a straight line that passes a distal end portion of the front stay and an upper end portion of the rear stay.

* * * * *